United States Patent [19]

Kawahara

[11] 4,314,407

[45] Feb. 9, 1982

[54] DRAFTING BOARD STORAGE TRAY

[76] Inventor: James B. Kawahara, 1721 S. Third St., Apt. B, Alhambra, Calif. 91803

[21] Appl. No.: 111,572

[22] Filed: Jan. 14, 1980

[51] Int. Cl.[3] ..... B43L 7/00

[52] U.S. Cl. ..... 33/444; 108/9

[58] Field of Search ..... 33/443-447; 108/6, 9

[56] References Cited

U.S. PATENT DOCUMENTS 353,477 11/1886 Bloemaker ..... 33/443

2,846,808 12/1958 Ivester ..... 108/9

*Primary Examiner*—Charles E. Phillips

*Attorney, Agent, or Firm*—Nilsson, Robbins, Dalgarn, Berliner, Carson & Wurst

[57] ABSTRACT

A drafting board tray for use in a drafting board having a cable guide track mounting for use with a straight edge assembly slideably adjustable on the cable guide track. The tray is disclosed to be pivotally attached and pivotally adjustably positionable at each end to two base mounts which are slideably adjustable on the cable guide track.

12 Claims, 8 Drawing Figures

DRAFTING BOARD STORAGE TRAY

BACKGROUND OF THE INVENTION

This invention relates generally to a novel drafting table tray for use on a drafting board having a cable guide track mounting for its straight-edge assembly, which assembly is slideably adjustable on the cable guide track as is well known in the art. The tray is pivotally attached and pivotally adjustably positionable at each end thereof to a pair of base mounts which are slideably adjustable on the cable guide track. In addition, the base mounts have a friction pad on the bottom thereof to hold the tray in a desired location on the drafting board when the board is tilted, and a roller for easy movement of the mounts longitudinally from top to bottom of the board when the mount is tilted sufficiently to remove the contact between the drafting board and the friction plate.

In the past it has been common to provide trays for drafting boards which are pivotally adjustable to maintain the tray in a horizontal position to compensate for the drafting board being tilted. The patent to Ivester, U.S. Pat. No. 2,846,808 shows a drafting board tray which is tiltably adjustable to accommodate any angle of the drafting board and adjustably positionable along the surface of the table. However, in order to adjustably position the tray on the surface of the table, it is necessary to release four wing nuts and slide the bracket mounting of the tray in an elongated longitudinal slot, thus making it very inconvenient to change the position of the tray in order to work on portions of the drafting board being blocked by the tray. In addition, the brackets and tracks necessary for the apparatus shown in the patent to Ivester, which tracks must be underneath the drafting board and which brackets must then extend outwardly from the board sides, in order to allow the straight edge assembly to pass under the tray, can interfere with the lowering of some drafting boards on a drafting table to the fully untilted position.

It is well known in the art to use a continuous cable and a series of rotatable cable guides to position a straight edge assembly longitudinally up and down the surface of the drafting board. This is shown, e.g., in the patents to DeLisle and Koch, respectively, U.S. Pat. Nos. 2,194,889 and 1,568,850.

Rollers have been used to position adjustable trays on the surface of a drafting board. The patent to Miller, Jr., U.S. Pat. No. 3,643,605 shows a pivotally adjustable tray which is pivotally mounted on a strut. The strut extends longitudinally from top to bottom of the board and is positionable laterally across the board by rolling it on rollers contained in carriages attached to the upper and lower ends of the strut. However, the strut shown in the patent to Miller, Jr. depends on roller engagement of a lower guideway, projecting up from the lower end of the drafting board, for preventing the strut from sliding off of the table top when the board is tilted upward. Such a projection at the lower end of the drafting board is often undesirable. In addition, the longitudinal orientation of the strut necessarily limits the lateral extension, and thus the size, of the tray, without using an inconvenient plurality of struts, lest the tray become unstable when objects are set upon its lateral extremities. Further, at some angle of upward tilt of the drafting board, the tray will have the extension of its center of gravity outside of the surface of the drafting board and guideway, causing the top end of the strut to swing outwardly, absent some undisclosed track or guide to hold the strut top against the drafting board. The tray will thus fall off of the drafting board.

Thus it can be seen that the arrangements which exist in the prior art have, at best, a degree of utility in providing an adjustably positionable and pivotable tray for a drafting board. However, room for significant improvement remains.

The problems enumerated in the foregoing are not intended to be exhaustive, but rather are among many which tend to impair the effectiveness of previously known drafting board trays. Other noteworthy problems may also exist; however, those presented above should be sufficient to demonstrate that drafting board trays appearing in the art have not been altogether satisfactory.

SUMMARY OF A PREFERRED EMBODIMENT OF THE INVENTION

Recognizing the need for an approved adjustably positionable drafting board tray, it is, therefore, a general feature of the present invention to provide a novel drafting board tray which minimizes or reduces the problems of the type previously noted.

A more particular feature of the present invention resides in the drafting table board tray for use on a drafting board having a cable guide rack mounting for its straightedge assembly, which assembly is slideably adjustable on the cable guide track.

Another feature of the present invention resides in a pair of tray mounts, each including a base with an end piece pivotally adjustably attached to the base and lockable in a desired pivotal position relative to the base, with the end piece engaging one end of the tray and with a first portion of the cable of the cable guide track entering the base from the direction of the top of the drafting board and exiting the base to extend laterally across the drafting board to the opposite base, and with a second portion of the cable extending from the opposite base, entering the base and exiting the base in the direction toward the bottom of the drafting board.

Yet another feature of the present invention resides in a pair of guide wheels rotatably attached to the base by ball bearings for guiding and directing the passage of the portions of the cable through the base.

Still another feature of the invention resides in an engaging lock, contained on the base, which engages the end piece to prevent pivotal movement of the end piece, while allowing loosening of the engagement for selectively positioning the tray by allowing the end piece holding the tray to pivot to a desired position prior to locking the end piece in that position.

A further feature of the present invention resides in a roller rotatably mounted on the bottom of the base and a friction pad attached to the bottom of the base, with the friction pad preventing the base from sliding on the tilted drafting board and the roller allowing easy positioning of the base along the track of the cable guide by lifting the base to remove contact between the friction pad and the drafting board and rolling the base on the roller to the desired location.

Examples of the more important features of the present invention have thus been summarized rather broadly in order that the detailed description thereof that follows may be better understood and in order that the contribution to the art may be better appreciated. There are, of course, additional features of the invention that will be described hereafter and which will also form the subject of the appended claims. These features and advantages of the present invention will become apparent with reference to the following detailed description of a preferred embodiment thereof in connection with the accompanying drawings, wherein like reference numerals have been applied to like elements, in which:

DETAILED DESCRIPTION OF A PREFERRED EMBODIMENT OF THE INVENTION

Figure 1:
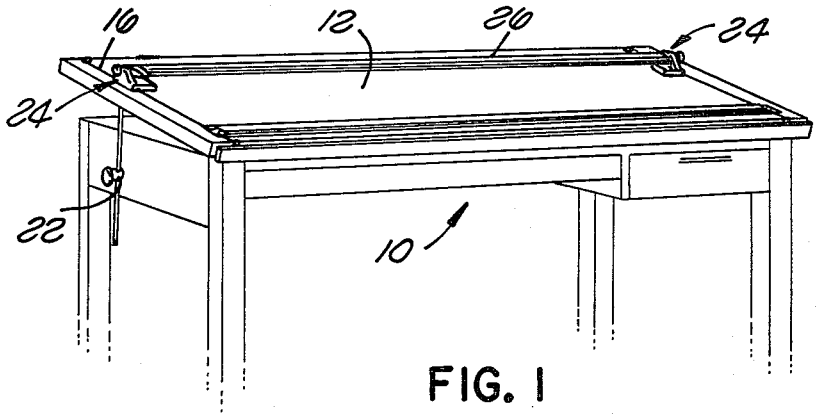
FIG. 1 depicts a perspective view of the present invention mounted on a drafting board in accordance with the present invention.
Figure 2:
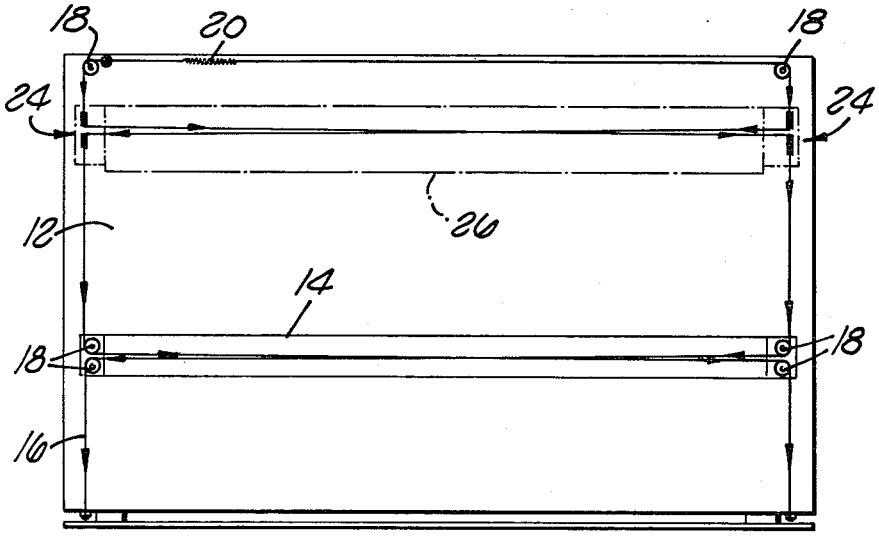
FIG. 2 shows a plan view of the cable guide of the present invention.

Turning first to FIGS. 1 and 2, a preferred embodiment of the invention is shown. FIG. 1 shows a typical drafting table 10 having a drafting board 12 which is pivotally attached, e.g., by hinges (not shown) to the drafting table 10. As is shown also more clearly in FIG. 2, the drafting table 10 has a straightedge asembly 14 which is, longitudinally of the drafting board from top to bottom thereof, slideably mounted on a cable 16. The cable 16, together with the associated rollers 18 of the cable guide track and also of the straightedge assembly 14, allows the straightedge assembly 14 to be selectively positioned longitudinally up and down the surface of the drafting board 12. The cable 16 may have a spring 20 connecting two ends of the cable 16 in order to give the cable guide track assembly some elasticity. As is shown in FIG. 1, the drafting board 12 is adjustably tiltable about the hinges (not shown) by a tilt-adjust 22.

In accordance with the present invention, a pair of tray mounts 24 for mounting a tray 26, which extends laterally across the width of the drafting board 12, is adapted to be slideably adjustable on the surface of the drafting board 12 on the same cable guide track and in a similar manner as is used for mounting the straightedge assembly 14.

Figure 3:
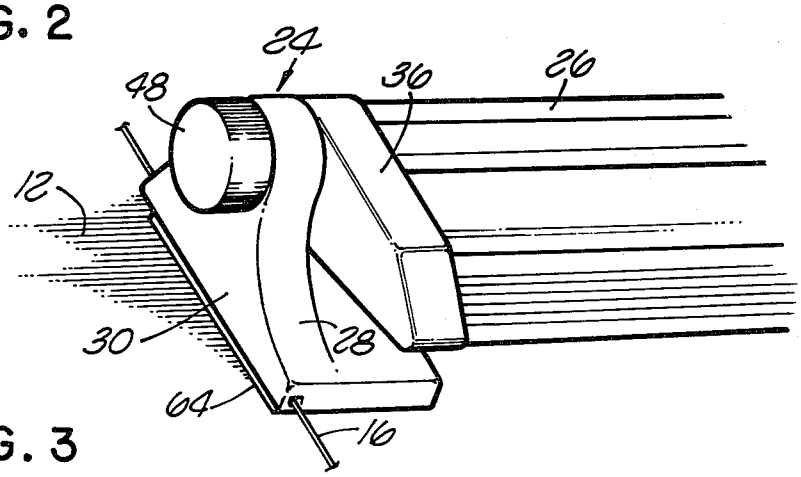
FIG. 3 depicts a perspective view of the tray mount according to the present invention.

Turning now to FIG. 3, one tray mount 24, according to the present invention, is shown, with the invention including a mirror image tray mount 24 at the laterally opposite side of the drafting board 12 to support the other end of the tray 26. The tray mount 24 has a base 28 and a side plate 30 which covers an internal cavity 31 (shown in FIGS. 4 and 5) in the base 28, as will be more fully described below. The base 28 is slideably moveable up and down the surface of the drafting board 12, longitudinally of the drafting board 12, from the top to the bottom and vice versa, as shown in FIG. 2, by being slideably adjustably mounted on the cable 16 of the typical drafting board 12 cable guide track.

Figure 4:
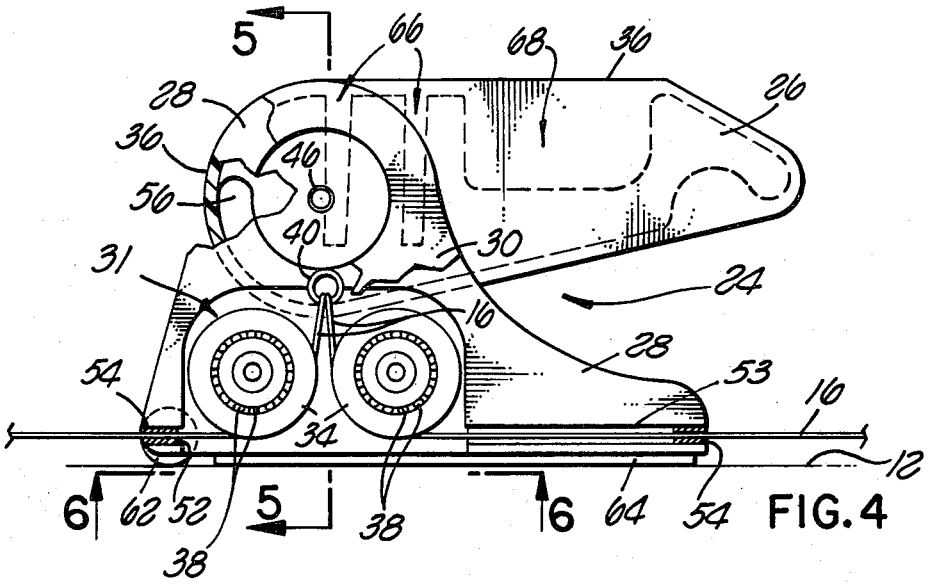
FIG. 4 is a partially cut away, at two separate levels, side elevational view of the tray mount according to the present invention with the side plate and knob removed.
Figure 5:
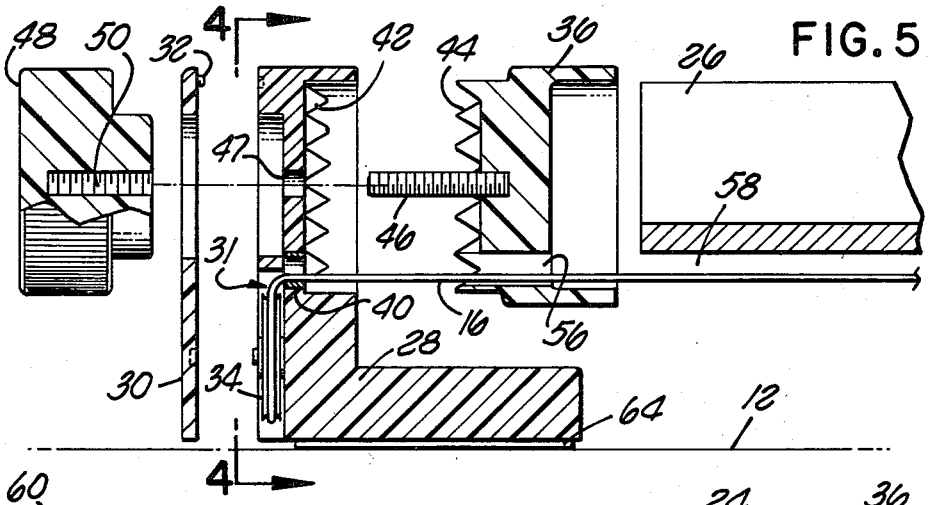
FIG. 5 is an exploded cross-sectional view of the tray mount according to the present invention.

Turning now to FIGS. 4 and 5, the tray mount 24 of the present invention is shown in greater detail. The lower portion of the side plate 30 has been cut away to reveal the inner cavity 31. The side plate 30 is preferably made of a plastic material and snaps on to the base 28 by means of studs 32.

The inner cavity 31 contains a pair of cable guides 34 which are rotatably attached to the base 28 by ball bearings 38. The base 28 has a metal ring 40 extending therethrough which defines a passage for portions of the cable 16. The base also contains an engaging member, including a plurality of circularly spaced teeth 42 which engage and lock a corresponding plurality of circularly spaced teeth 44 contained on a portion of the end piece 36. A tightening assembly is provided, including a threaded stud 46, disposed at the center of the circularly spaced teeth 44 on the end piece 36, and which stud 46 passes through a hole 47 in the base 28 and threads into a female portion 50 of a locking knob 48 in order to bring the teeth 42 of the base 28 and 44 of the end piece 36 into locking engagement as the knob 48 is twisted, thereby causing the shaft 46 to thread further into the female portion 50 of the knob 48.

As is shown in FIG. 4, the base 28 has a guideway 52 near the bottom of the base and opening into the internal cavity 31 from the side of the base facing the upper end of the drafting board 12. The guideway 52 has a metal guide or sleeve 54 through which the cable 16 passes, with the metal guide or sleeve serving to guard against frictional wear on the material of the base, e.g., aluminum. A similar, but longer, guideway 53 connects the internal cavity 31 with an opening for the cable 16 to pass towards the lower end of the drafting board 12, with the passageway 53 also having a metal or "Teflon" guide or sleeve 54 through which the cable 16 passes.

The metal ring 40 also serves to protect the plastic material of the base 28 from wear due to the portions of the cable passing through the opening defined by the metal ring 40 in the base 28. It may be desirable to incorporate a roller or adjacent guide wheels in the lower portion of the metal ring 40 to reduce the friction of the cables 16 passing over the lower portion of the ring 40. A passage way 56 extends through the end piece 36 to allow the portions of the cable 16 to pass through the end piece 36 after passing through the opening defined by metal ring 40.

Since the end piece 36 is pivotally adjustable with respect to the base 28, the passage 56 is a generally quarter circular hollowed-out portion of the end piece 36, which extends from a point where one end portion of the passage 56 is aligned with the opening defined by metal ring 40, when the end piece 36 is in the horizontal position parallel to the drafting board 12, as shown in FIG. 4, to a point approximately 90° from the first point as shown by the cutaway portion on the left hand side of FIG. 4. Thus, the guideway 56 can accommodate pivoting of the end piece 36 through at least approximately 90° without binding the portions of the cable 16. This should be sufficient to allow the tray 26 to be selectively positioned horizontally with respect to the ground when the drafting board 12 is tilted to any angle up to and including perpendicular to the drafting board table 10 and, thus, the ground. The bottom of the tray 26 also has a passage 58 which may simply be an open groove extending the length of the tray 26, through which the portions of the cable 16 may pass, as shown in FIG. 5, or may be an enclosed tunnel extending the length of the tray 26 through which the portions of the cable 16 pass.

Figure 6:
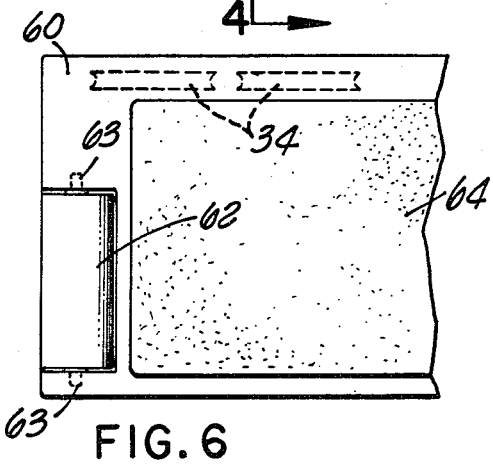
FIG. 6 is a bottom view of the tray mount according to the present invention.

Turning now to FIG 6, the tray mount 24 is shown to have a bottom surface 60. The bottom 60 has contained therein a roller 62, rotatably mounted on shafts 63 near the bottom 60 of the base 28. The shafts are aligned with the longitudinal axis of the tray 26 and, thus, with the width of the drafting board 12, and perpendicular to the height, i.e., longitudinal dimension of the drafting board 12. The base 28 also has a friction pad 64 made of a suitable material, e.g., cork or neoprene rubber, which will hold the tray mount 24 against sliding along the surface of the drafting board 12 when the drafting board 12 is tilted. As can be seen more fully in FIG. 4, the roller 62 is of such a size and the shafts 63 are positioned such that when the base 28 is resting flatly on the drafting board 12, the friction pad 64 lies flat on the surface of the drafting board 12, and the roller 62 will just touch the surface of the drafting board 12 as shown in FIG. 4, or may not touch the surface of the drafting board 12, but, in either event, is not of sufficient size to interfere with the friction pad 64 lying flatly on the surface of the drafting board 12.

In operation, the tray 26, which is preferably an elongated member of extruded aluminum in any desired shape, e.g., having vertically extending grooves 66 and a more widely open tray portion 68, is inserted into the end piece 36 and engaged thereby. The end piece 36 is preferably of molded plastic, and also preferably shaped, on the side receiving the end of the tray 26, in a shape conforming to the cross-sectional shape of the tray 26, in order that the tray 26 may be snugly inserted into the end piece 36. The end piece 36 of each of the tray mounts 24 and each end of the tray 26 is then pivotally adjusted by loosening the knobs 48 sufficient to disengage the teeth 42, 44, allowing the pivoting of the end pieces 36 to the desired position of the tray 26 with respect to its angular relationship to the surface of the tilted drafting board 12, preferably maintaining the tray in a horizontal position. The knobs 48 are then twisted until the teeth 42, 44 on each of the tray mounts 24 are engaged, thus locking the end piece 36, and consequently the tray 26 in a desired position.

Figure 7A:
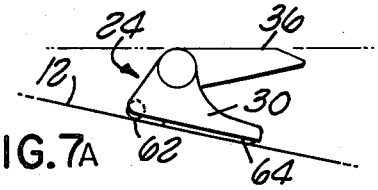
FIGS. 7A and 7B illustrate the operation of the friction pad and roller of the tray mount according to the present invention.
Figure 7B:
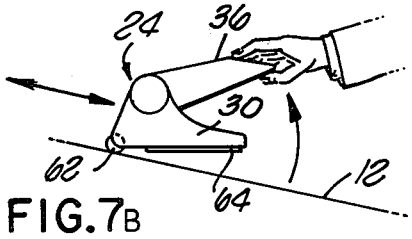

When it is desired to move the tray mounts, and thus the tray longitudinally from top to bottom or vice versa, along the surface of the drafting board 12, the end piece 36 or the tray 26 is simply lifted as shown in FIG. 7B to disengage the contact between the friction pad 64 and the top surface of the drafting board 12, thereby facilitating rolling the tray mounts 24 upwardly or downwardly along the surface of the drafting board 12 on rollers 62. The tray mounts 24 move longitudinally on the drafting board 12 in line with the longitudinal alignment of the cable 16 of the cable guide track. When the desired position is achieved, the end piece 36 or tray 26 is released causing the friction pad 64 to again lie flatly on the surface of the drafting board 12, thereby frictionally holding the tray mounts 24 against sliding along the surface of the drafting board 12. As the tray mounts 24 are slideably moved along the surface of the drafting board 12, the cable guide track maintains a relative position between the tray mounts 24 and guides the tray mounts 24 in a straight line upwardly or downwardly along the lateral edges of the drafting board 12. Assuming, for example, that the tray mounts 24 are being moved towards the upper end of the drafting board 12, i.e., to the left as shown in FIG. 4, the cable guide track assembly works as follows: the tray mount 24 will move along the cable 16 with the cable 16 entering the internal cavity 31 through guideway 52 and being guided by the forward or leftmost of the guide wheels 34 through a 90° angle, approximately, to enter the opening defined by metal or "Teflon" ring 40 through the base 28, and the guideway 56 and guideway 58, connecting with the corresponding guideway 56 and opening defined by the metal ring 40 in the other tray mount 24 at the opposite lateral edge of the drafting board 12. As shown in FIG. 2, the cables 16 cross at approximately midway between the tray mounts 24 so that the cable entering guideway 52 in the left-hand tray mount shown in FIGS. 1 and 2 will exit through guideway 53 and the right hand cable mount 24.

Similarly, with the left-hand tray mount 24, shown in FIG. 4, the portion of the cable 16 which entered the other tray mount 24 on the right-hand side of the drafting board, through guideway 52 from the upper end of the drafting board 12, will pass through the opening defined by metal ring 40, shown in FIG. 4, over the rearward or right-hand guide wheel 34 and through guideway 53, exiting in the direction of the lower end of the drafting table 12. In this way, the cable guide track holds the tray mounts 24 on the drafting table 12, guides their movement up and down the lateral edges of the drafting table 12, and maintains their relative positions in order to keep the tray parallel with the width of the drafting table 12, i.e., horizontal, as shown in FIG. 2.

SUMMARY OF THE ADVANTAGES AND SCOPE OF THE INVENTION

It will be appreciated that in constructing a drafting board tray mount according to the present invention, certain significant advantages are provided.

In particular, a tray mount 24 is provided which is easily slideably adjustable up and down the height of the drafting board 12, which tray 26 is selectively pivotally positionable to maintain its horizontal orientation with respect to the ground when the drafting board 12 is tilted, and which tray 26 extends laterally across essentially the entire drafting board 12.

The mounting for the tray is simplified and made inexpensive by simply having to add a sufficient length of cable to a typically already existing cable guide track for the drafting board 12 straight edge assembly 14.

The tray 26 is able to extend the entire lateral width of the drafting board 12 without being unstable and is horizontally pivotally positionable with a simple turn of the knob, rather than a plurality of wing nuts, and selectively longitudinally positionable up and down the surface of the drafting table 12, with a simple lifting motion and a push or a pull, on the tray 26 or mounts 24 as opposed to loosening of a plurality of wing nuts, as was common in the prior art.

The foregoing description of the invention has been directed to a particular preferred embodiment in accordance with the requirements of the patent statutes and for purposes of explanation and illustration. It will be apparent, however, to those skilled in this art that many modifications and changes in both apparatus and method may be made without departing from the scope and spirit of the invention. For example, the particular means of engaging the end piece 36 against pivotal rotation, once in the desired position, i.e., the teeth 42, 44 shown in FIG. 5, may be modified to include any suitable means for engaging the end piece 36 against further pivotal motion once it is in a desired pivotal position, as is well known in the art. Also, it will be further apparent that the invention may be utilized, with suitable modifications, within the state of the art, which modifications will be apparent to those skilled in this art. It is the applicant's intention in the following claims to cover all such equivalent modifications and variations as fall within the true spirit and scope of the invention.

What is claimed is:

1. A drafting board tray, for use on a drafting board having a cable mounted slideable straightedge assembly, comprising:

a first and a second tray mount;

a tray extending between said first and second tray mounts; and each of said first and second tray mounts comprising:

a base;

an end piece pivotally adjustably attached to said base and held in a desired pivotal position relative to said base; said piece engaging a respective end of said tray; and a cable guide mounted on said base and adapted to feed a first portion of the cable used for slideably mounting the straightedge assembly to the other of said first and second tray mounts and to receive from said other of said first and second tray mounts a second portion of the cable used for slideably mounting the straightedge assembly, thereby to slideably mount the said base to the drafting board, said cable guide further comprising:

a first and a second guide wheel rotatably attached to said base;

said base having an upper and a lower end and the drafting board having an upper and a lower end;

a first passage in said upper end of said base and a second passage in said lower end of said base;

a third passage extending through said base;

said first portion of the cable entering said base through said first passage from the direction of said upper end of the drafting board, passing over said first guide wheel and through said third passage to said other of said first and second tray mounts; and, said second portion of the cable entering said base through said third passage from the direction of said other of said first and second tray mounts passing over said second guide wheel and passing out of said base through said second passage in the direction of said lower end of the drafting board.

2. The apparatus of claim 1, further comprising:

said base has contained thereon an engaging member which engages said end piece to prevent said end piece from pivotal movement and is adapted to enable loosening of said engagement, allowing pivoting of said end piece, and thereby said tray, to a desired position.

3. The apparatus of claim 2 wherein said engaging member further comprises:

a first set of teeth contained in said base;

a second set of teeth contained on said end piece; and, a tightening member adapted to draw said first set of teeth into locking engagement with said second set of teeth.

4. A drafting board tray, for use on a drafting bord having a cable mounted slidable straightedge assembly, comprising:

a first and a second tray mount;

a tray extending between said first and second tray mounts; and each of said first and second tray mounts comprising:

a base;

an end piece pivotally adjustably attached to said base and held in a desired pivotal position relative to said base, said end piece engaging a respective end of said tray; and, a cable guide mounted on said base and adapted to feed a first portion of the cable used for slideably mounting the straightedge assembly to the other of said first and second tray mounts and to receive from said other of said first and second tray mounts a second portion of the cable used for slideably mounting the straightedge assembly, thereby to slideably mount the said base to the drafting board;

said base having contained thereon an engaging member which engages said end piece to prevent said end piece from pivotal movement and is adapted to enable loosening of said engagement, allowing pivoting of said end piece, and thereby said tray, to a desired position, said engaging member further comprising:

a first set of teeth contained in said base;

a second set of teeth contained on said end piece; and a tightening member adapted to draw said first set of teeth into locking engagement with said second set of teeth.

5. The apparatus of claim 4, 2 or 3, further comprising:

said base having a bottom, and a roller rotatably mounted on said bottom and rotatable about an axis parallel to the width of the drafting board.

6. The apparatus of claim 4, 2 or 3, further comprising:

said base having a bottom; and a friction pad attached to said bottom.

7. A drafting board tray, for use on a drafting board having a cable mounted slideable straightedge assembly comprising:

a first and a second tray mount;

a tray extending between said first and second tray mounts;

each of said first and second tray mounts comprising:

a base;

an end piece pivotally adjustably attached to said base by an engaging member which engages said end piece to prevent pivotal movement of said end piece and is adapted to disengage said end piece to allow pivoting said end piece, and thereby said tray, to a desired position, said end piece engaging a respective end of said tray and holding said respective end against movement relative to said end piece; and, a cable guide attached to said base including:

a first and a second guide wheel rotatably attached to said base;

a first and a second guide wheel rotatably attached to said base;

said base having an upper and a lower end and the drafting board having an upper and a lower end;

a first passage in said upper end of said base and a second passage in said lower end of said base;

a third passage extending through said base;

a first portion of the cable entering said base through said first passage from the direction of said upper end of the drafting board, passing over said first guide wheel and through said third passage to the other of said first and second tray mounts; and, a second portion of the cable entering said base through said third passage from the direction of the other of said first and second tray mounts, passing over said second guide wheel and passing out of said base through said second passage in the direction of said lower end of the drafting board.

8. The apparatus of claim 7 wherein said engaging member further comprises:

a first set of teeth contained in said base;

a second set of teeth contained in said end piece; and, a tightening member adapted to draw said first set of teeth into locking engagement with said second set of teeth.

9. The apparatus of claim 8, further comprising:

said base having a bottom; and, a roller rotatably mounted on said bottom and rotatable about an axis parallel to the width of the drafting board.

10. The apparatus of claim 8, further comprising:

said base having a bottom; and, a friction pad attached to said bottom.

11. A drafting board tray, for use on a drafting board having a cable mounted slideable straightedge assembly, comprising:

a first and a second tray mount;

a tray extending between said first and second tray mounts; and each of said first and second tray mounts comprising:

a base;

an end piece pivotally adjustably attached to said base and held in a desired pivotal position relative to said base, said end piece engaging a respective end of said tray; and, a cable guide mounted on said base and adapted to feed a first portion of the cable used for slideably mounting the straightedge assembly to the other of said first and second tray mounts and to receive from said other of said first and second tray mounts a second portion of the cable used for slideably mounting the straightedge assembly, thereby to slideably mount the said base to the drafting board;

said base having contained thereon an engaging member which engages said end piece to prevent said end piece from pivotal movement and is adapted to enable loosening of said engagement, allowing pivoting of said end piece, and thereby said tray, to a desired position, said base having a bottom, and a roller rotatably mounted on said bottom and rotatable about an axis parallel to the width of the drafting board.

12. The apparatus of claim 11 including a friction pad attached to the bottom of said base.

* * * * *